United States Patent [19]

Frederick

[11] Patent Number: 4,750,625

[45] Date of Patent: Jun. 14, 1988

[54] SHELF AND DIVIDER ARRANGEMENT

[75] Inventor: Martin Frederick, New York, N.Y.

[73] Assignee: Supreme Equipment & Systems Corp., Brooklyn, N.Y.

[21] Appl. No.: 17,850

[22] Filed: Feb. 24, 1987

Related U.S. Application Data

[63] Continuation-in-part of Ser. No. 904,631, Sep. 8, 1986, abandoned.

[51] Int. Cl.[4] ..... A47F 5/00

[52] U.S. Cl. ..... 211/184; 108/153

[58] Field of Search ..... 211/43, 184, 181, 153, 211/40, 41, 42, 183; 108/153, 157; 312/294, 330, 330 SM

[56] References Cited

U.S. PATENT DOCUMENTS

| | | | |
|---|---|---|---|
| 660,264 | 10/1900 | Storm | 211/184 |
| 989,566 | 4/1911 | Callaghan | 211/184 X |
| 2,346,150 | 4/1944 | Brown | 211/184 X |
| 2,868,391 | 1/1959 | Sides | 211/184 X |
| 2,933,195 | 4/1960 | Radek | 211/184 X |

*Primary Examiner*—Ramon S. Britts
*Assistant Examiner*—Sarah A. Lechek Eley
*Attorney, Agent, or Firm*—Lieberman, Rudolph & Nowak

[57] ABSTRACT

An improved shelf is provided with a divider arrangement formed of a substantially resilient material having portions for engaging with vertical and horizontal members of the shelf, the divider arrangement providing stiffening and support for the shelf.

7 Claims, 3 Drawing Sheets

SHELF AND DIVIDER ARRANGEMENT

This application is a continuation-in-part of Ser. No. 904,631, filed Sept. 8, 1986, now abandoned.

FIELD OF THE INVENTION

This invention relates generally to an improved shelf with divider arrangement for file cabinets, and the like, and more particularly, to a shelf with a file divider arrangement formed of a wire-like material having resilient portions for engaging with vertical and horizontal surfaces, the divider arrangement providing stiffening and support for the thin sheet metal shelf.

BACKGROUND OF THE INVENTION

There has long existed a need for a simple and economical divider arrangement which can be used to separate various classification of files, books and other classifiable articles. It is a requirement of such divider systems that they be placed longitudinally, at spaced intervals, along a shelf. This placement permits the numbers of files in the various classifications to be varied, while maintaining the remaining files in desired vertical positions. Vertical positioning maximizes the utilization of space in a file cabinet drawer or on a shelf, and prevents warping of the documents stored within the files.

Several divider arrangements have been proposed in the prior art, which divider arrangements have functioned well, but have not been simple in their construction and inexpensive to the purchaser. One well known divider system for a file cabinet drawer is formed of a sheet material, such as a sheet metal, which has been formed in two parts, a divider part and a track engagement part. The track engagement part is provided with a base having a forwardly projecting tongue which has a substantially T-shaped form. Underneath the base is provided a locking portion which is bent to have depending flanges in an inverted U-shaped configuration. The locking portion is secured to the base by a screw, a rivet, or the like. Above the base is provided the divider portion of the arrangement, which physically separates the files. Finally, the locking portion engages with a track which must have sufficient depth to accommodate the flanges of the U-shaped locking portion and a shaft which bears a cam for locking the divider arrangement at a desired location along the track.

In addition to its obvious complexity, this known divider arrangement requires a substantial track depth which consumes a considerable volume within a file cabinet. Moreover, such a divider arrangement is not suitable for shelving because, for long runs of shelving, the cam shaft with its associated trunion bearings is prohibitively expensive. In addition, this arrangement is very inconvenient for use in conjunction with long shelves, and the actuation of the shaft would release all of the dividers on the shelf, even though only one or two dividers thereon may be desired to be affected. The prior art has endeavored to overcome the complexity and expense of the known divider arrangements by providing a further device constructed of bent sheet metal which has been formed into a loop with resilient arms and provided with bent flanges which engage beneath the flanges of a track. The apex of the bend of one of the flanges of the loop is provided with a sheet metal tongue, and the other bend, at its apex, is provided with matching aperture such that when the flanges of the loop are engaged with the track, the tongue engages with the aperture at the respective bends of the loop to prevent the resilient arms of the loop from moving laterally with respect to each other and out of alignment. Although this known arrangement provides substantial advantages in terms of diminished complexity and cost over the divider arrangement discussed hereinabove, this arrangement nevertheless requires the stamping of a blank for forming the resilient loop, the production of the tongue and the aperture, the notching of a base on which the files rest, and the installation of a track and a notch. Thus, notwithstanding that this arrangement does not require a shaft with a cam, as does the previously discussed arrangement, this arrangement has the disadvantages that it is longitudinally relatively thick and therefore takes up substantial file space on the shelf or in the drawer where it is installed. In addition, the known configuration is deeper at the bottom that at the top thereby being adaptable for restraining files predominantly in one direction only.

Many of the disadvantages of the foregoing prior art arrangements are overcome by a further known divider arrangement (U.S. Pat. No. 1,477,234) which is formed of a spring wire which is curved to form a vertical loop which supports the files in their vertical position. This further known arrangement is provided with a rod which is arranged parallel to the longitudinal dimension of the drawer or shelf on which it is arranged and is raised above the base of the shelf or drawer by several inches. The rod, therefore, runs longitudinally along side the upright files. The divider is provided with a coiled end which is spiraled around the rod in a direction opposite to the force applied against the loop by the vertical files. Thus, although this arrangement is simple and inexpensive, it is subject to the disadvantages of requiring a rod to be placed along side the stack of files, and of allowing the files to be placed on only one side of the divider. In addition, in embodoments where the files are placed on a shelf, the rod renders difficult removal of the files from one side of the shelf and, in filing systems which utilize long shelves, periodic reinforcements are required for the rod.

Anothr known shelf divider arrangement involves a plurality of longitudinally spaced slots running the length of the horizontal shelf base. The vertical shelf back also carries spaced slots in alignment with the horizontal slots on the shelf base. A divider comprising a flat piece of sheet metal is provided with engagement membeers at respective orthogonal edges which fit into corresponding slots on the base member and the vertical back. Clearly, this known arrangement requires careful alignment of the vertical and horizontal slots, thereby greatly increasing the cost of manufacture.

U.S. Pat. No. 3,625,581 to P. Frederick and assigned to the present assignee describes an improved form of office filing cabinet comprising the use of vertical separators spaced apart horizontally on each shelf. The structural support provided by these separators eliminates the donwturned lip present on standard prior art shelves. This downturned lip, often as much a 1½ to 2 inches in depth, represents wasted space, so that, for example a 12 inch wide shelf actually takes up 14 inches. As described in the patent, if the separators are affixed to the shelf and the vertical back thereof, they will provide the necessary stiffening of the shelf eliminating the need for the downturned lip.

The present invention comprises an improvement of the shelf disclosed in the '581 patent by combining it with the novel divider arrangement described herein.

It is, therefore, an object of this invention to provide a simple and inexpensive file divider arrangement which overcomes many of the disadvantages of the prior art and yet is simple and economical.

It is a further object of this invention to provide a shelf with a divider arrangement which can be formed easily without the need for continuous tracks, flanges, or other structurally supported elements.

It is a still further object of this invention to provide a shelf with a divider arrangement which can support files, books, or other items from either side thereof.

It is still another object of this invention to provide a shelf with a divider arrangement which does not require substantial longitudinal space on a shelf or in a drawer of a file cabinet.

It is also a further object of this invention to provide a shelf with a divider arrangement which is simple in construction, and can be inserted, or removed, in a simple operation.

It is also a further object of this invention to provide a divider arrangement which, when utilized on a horizontal shelf filing system, can be easily inserted from the underside of a shelf without difficulty.

It is yet another object of this invention to provide a shelf with a divider arrangement wherein the base does not require a separate track arrangement affixed thereto.

It is also another object of this invention to provide a divider system wherein dividers can be used at spaced intervals along a horizontal shelf where desired, and wherein the dividers themselves are easily fabricated from somewhat resilient material.

It is a still further object of this invention to provide an improved shelf for a filing cabinet which utilizes the divider arrangement described herein to provide stiffening and rigidity to the shelf thereby eliminating the need for a downturned lip.

SUMMARY OF THE INVENTION

In its broad aspect, the present invention is directed to a shelf comprising an adjustable divider arrangement. The shelf is provided with a horizontal base member for supporting files, books, or other items which are desired to be filed, and a plurality of divider members for engaging with a back member and the base member at spaced intervals along the longitudinal axis of the base member. The divider arrangement is provided with a plurality of spaced openings or slots in the base member, which slots are configured so as to be axially aligned perpendicular to the longitudinal axis of the base member, with each set of slots separated from one another by a predetermined offset distance.

As hereinbefore indicated, the divider 18 can be informed of a continuous length of somewhat resilient material, portions of which communicate with a horizontal base member and an anchoring means disposed in proximity to the back member of the shelf or cabinet. The lateral force which is applied against the divider arrangement by the filed items is not sufficient to displace it from the slots because the divider member is restrained by its engagement with the base member and anchoring means. Thus, even though the divider may be easily removed from the shelf by applying a force which tends to lift first the portion of the divider member which communicates with the anchoring means, such removal requires a certain amount of force to be applied, while the items filed generally apply only a lateral force which is not in the same axis to the required removal force. By such an arrangement, therefore, the divider is removable from the shelf by the application of forces thereto which cannot be applied by the filed items. In addition, the dividers a provide stiffening and rigidity to the base member, eliminating the need for a downturned structural support "lip".

It is an advantage of this invention that the back and base members can be constructed easily without requiring special features. It is also an advantage of this invention that the divider can be formed entirely of a material which is somewhat resilient. The divider can be metal, plastic, reinforced plastic or other similarly resilient material. It is also an advantage of the invention that it comprises a shelf which requires no structural "lip".

In one embodiment of the present invention, a separate "U"-shaped auxiliary member can optionally be employed to prevent files stored on the shelves from slipping sideways, behind, or underneath, the dividers. The U-shaped member, which can also be fabricated from the same resilient material as the divider itself, is held in place by inserting the ends of the member into auxiliary slots on the base member of the shelf.

In one embodiment, the divider engagement means are formed of a continuous resilient rod material, such as spring wire, having a predetermined diameter. Diameters for such rods can vary from as little as 1 millimeter to 5 or more millimeters. The base member can be formed of a sheet material such as metal, plastic or wood, the slots being formed by removing a portion of the material by drilling, punching, molding or the like. The overall thickness and lengths of such sheet material will vary depending upon the particular file system.

BRIEF DESCRIPTION OF THE DRAWINGS

The shelf and divider arrangement of the present invention will be more readily understood by reference to the following detailed description in conjunction with the annexed drawings, in which.

DETAILED DESCRIPTION

Figure 1:
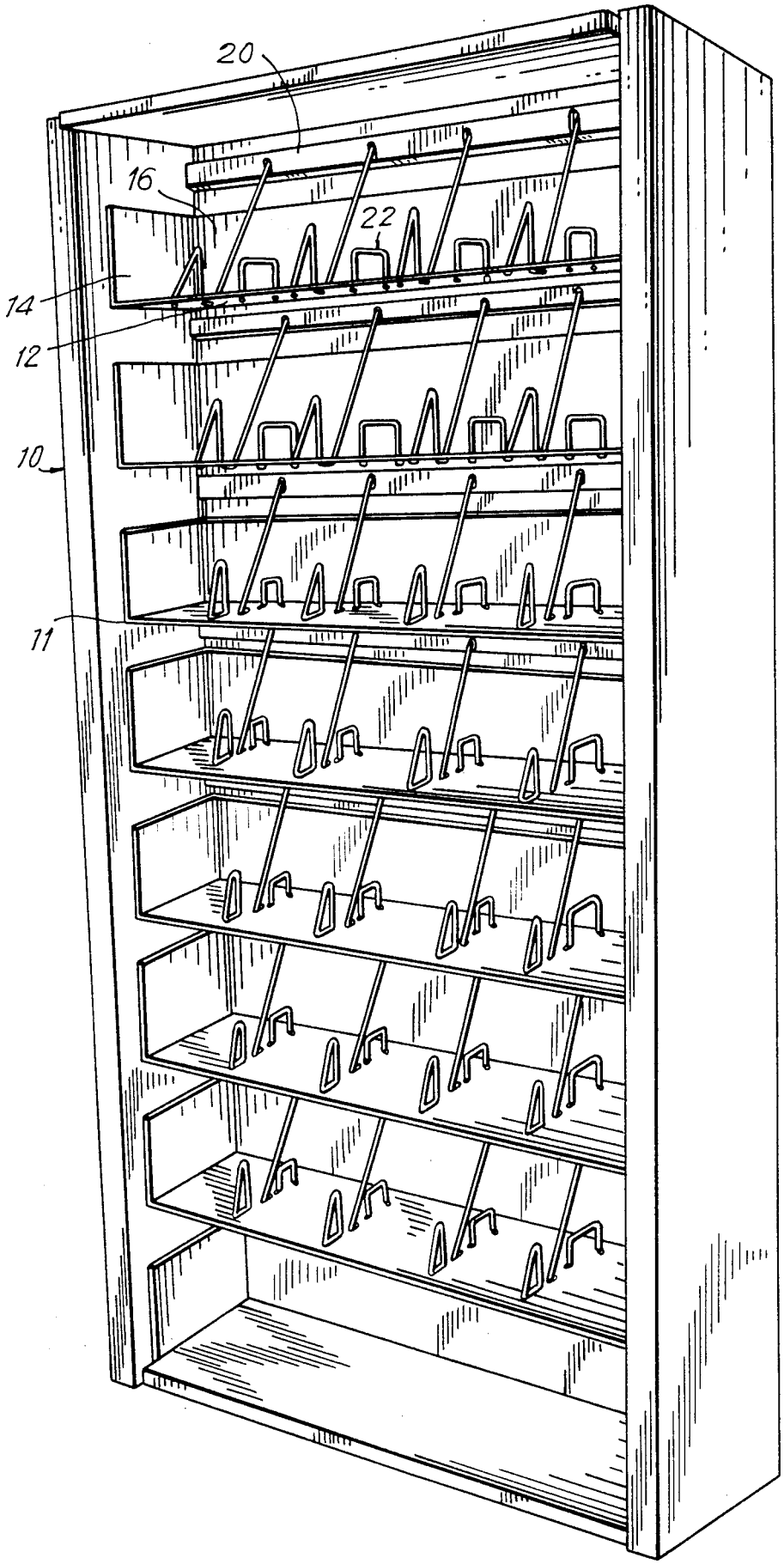
FIG. 1 is a representation of a filing cabinet including a plurality of horizontal shelves with dividers formed of a somewhat resilient material, fixed in place with one form of anchoring means.

FIG. 1 is a representation of a file cabinet 10 fitted with a plurality of shelves 11 each comprising a base member 12, two side members 14 (only one shown), vertical back member 16, and a plurality of dividers 18 and anchoring means 20. Auxiliary divider means 22 can be used in conjunction with dividers 18 to further maintain files in an upright position and prevent smaller books or files from slipping between and under 18.

In this embodiment, the anchoring means 20 is attached to the the frame of the file cabinet 10, proximate to the top edge of the back member 16, although not directly attached to the back member 16. The anchoring means 20 comprises a horizontal member with a plurality of slots for communicating with the rear engaging means 52 of dividers 18.

Figure 2:
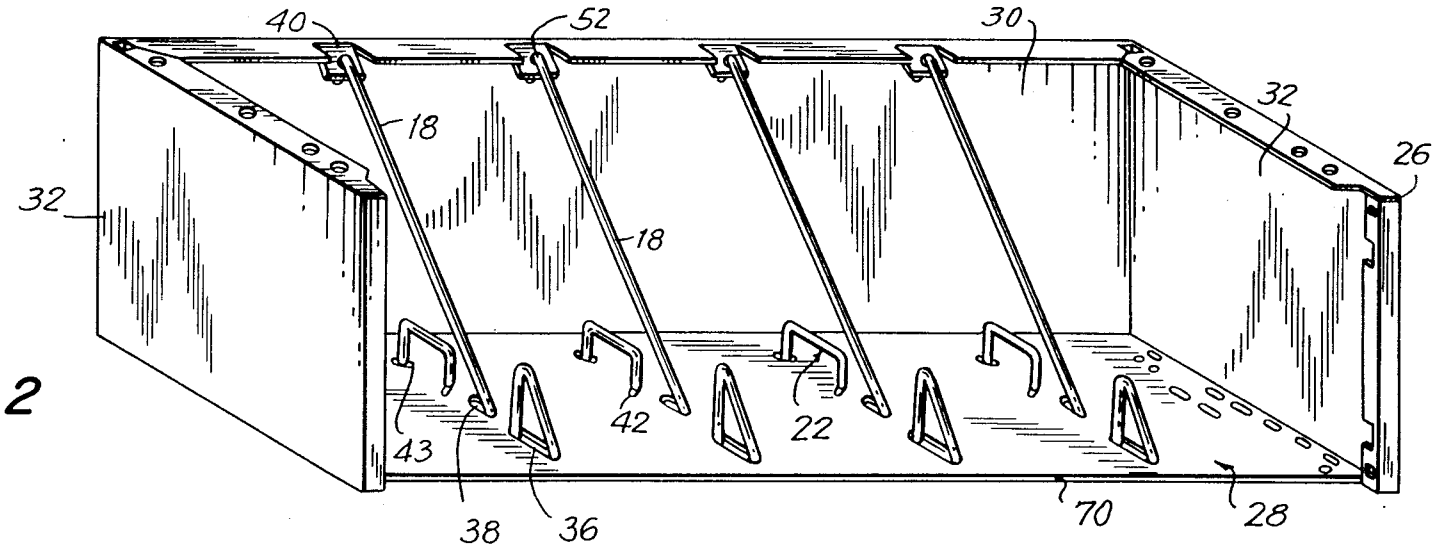
FIG. 2 is a representation of a second embodiment of the shelf having dividers engaged with a base member and anchoring means connected to the upper edge of the vertical back member.

FIG. 2 is a representation of another embodiment of the shelf 26, comprising a horizontal base member 28 with a longitudinal axis, a vertical back member 30 perpendiculsar to the base member 28 and disposed adjacent to a first longitudinal edge of said base member 28, two side members 32, a plurality of dividers 18, first slot means 36, second slot means 38 and anchoring means 40. In this embodiment, the anchoring means 40 is attached to the upper edge of the back member 30. The anchoring means 40 comprises a flange having a slot or opening for engaging the rear engaging means 52 of divider 18. A plurality of auxiliary slots 42 and 43 "U" shaped auxiliary divider means 44 are also shown.

Figure 3:
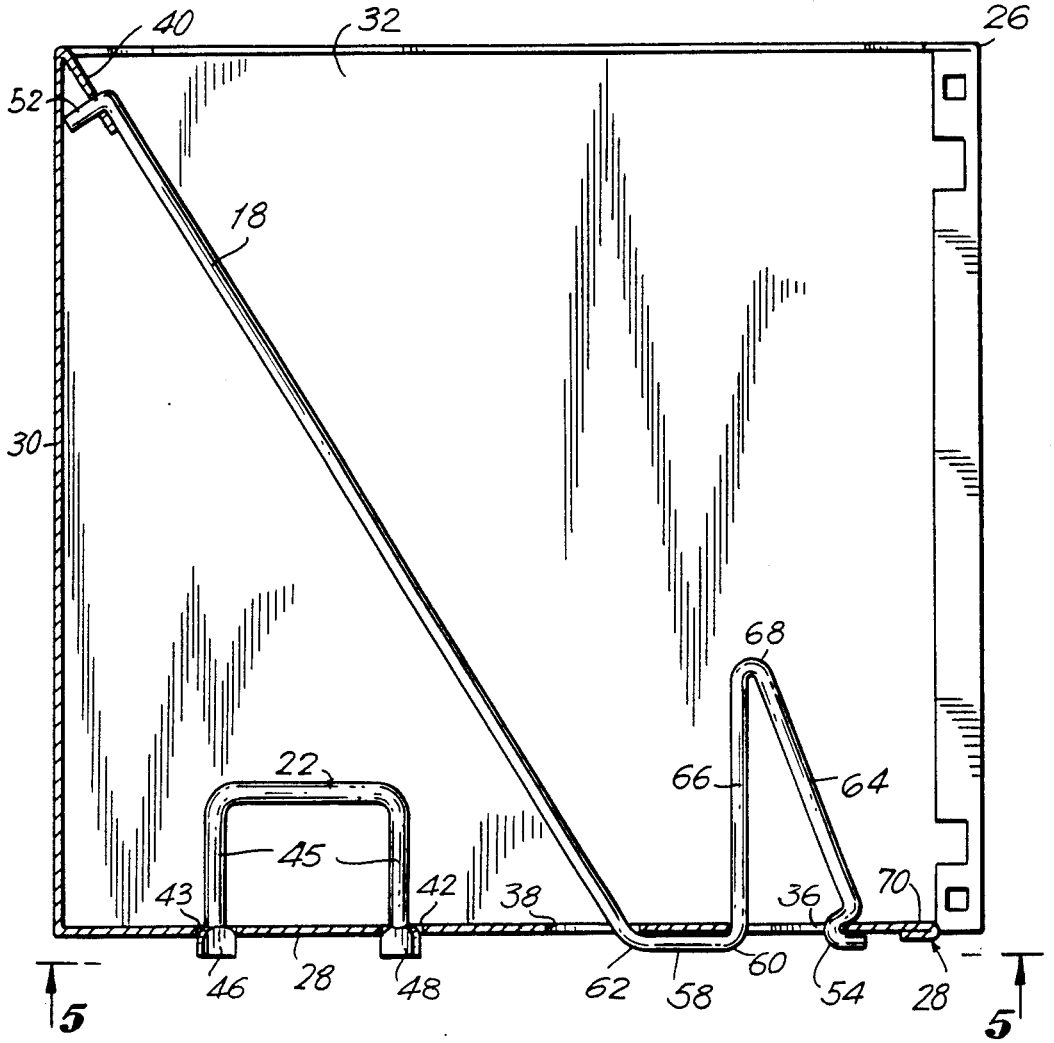
FIG. 3 is a partial cross-sectional plan view of the embodiment described in FIG. 2.

FIG. 3 is a partial cross-sectional plan view of the embodiment describes in FIG. 2. FIG. 3 shows front engaging means 54 and rear engaging means 52 of divider 18.

Divider 18 and auxiliary divider means 22 can each be fabricated from a single, continuous length of a somewhat resilient, rod shaped material. The material can be metal, plastic, reinforced plastic and the like.

Divider 18 has a flat portion 58, formed at bends 60 and 62, which is disposed on the under surface of the base member 28 of the shelf 26, and a loop portion 64 comprised of vertical portion 66, which bends at 68 and ends at engaging means 54. Front engaging means 54 is configured as a detent to engage the outermost side of slot 36 in base member 28 to fixedly secure divider 18 in place. Divider 18 terminates at its other end with rear engaging means 52 which is angularly configured as a hook to engage anchoring means 40 attached to back member 30.

Figure 4:
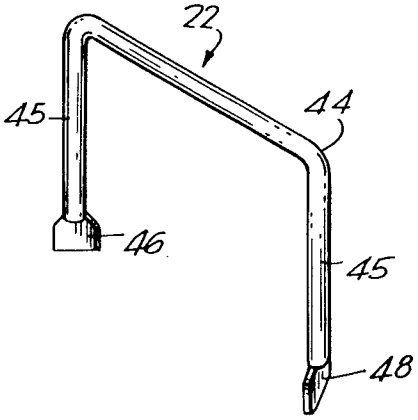
FIG. 4 is an isometric side view of a single optional "U" shaped auxiliary divider.

FIG. 4 is an perspective view of a single "U" shaped auxiliary divider means 22 having end tabs 46 and 48 angularly posiioned with respect to the cross piece 50 of divider means 22.

Figure 5:
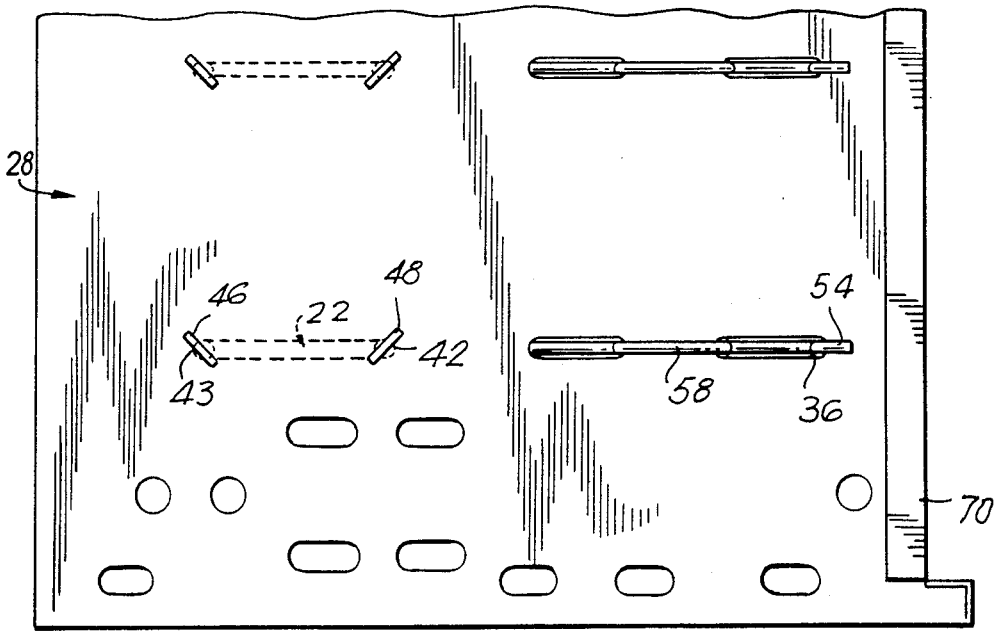
FIG. 5 is a bottom view of the embodiment described in FIG. 2.

FIG. 5 is a partial bottom side view of base member 28 showing auxiliary slot means 42 and 43, first slot means 36, second slot means 38, flat portion 58 and front engaging means 54 of divider 34.

Auxiliary slot means 42 and 43 are angularly positioned with respect to the longitudinal axis of shelf 28, along which first, second and auxiliary slot means, 36, 38, 42 and 43 respectively are aligned. End tabs 46 and 48 of auxiliary divider means 22 are inserted into auxiliary slot means 42 and 43 respectively. The outward tension on arms 45 of auxiliary divider means 22 is sufficient to maintain the member in place on base member 28.

Also indicated in FIGS. 3 and 5 is the finished forward edge 70 of base member 28. This folded edge or "hem" is used to prevent accidental injury from an otherwise sharp edge and enhances the appearance of the shelf 26. The hem 70 provides negligible structural support for the base member 28.

As hereinbefore indicated, the divider 18 cn be inserted or removed from the base member 28 and anchoring means 20 or 40 in a very simple and rapid fashion. Rear engaging means 52 of divider 18 is inserted from beneath base member 28 through second slot meand 38. Rear engaging means 52 is then inserted into anchoring means 40 (or 20) and bend 68 of loop portion 64 is aligned with first slot means 36. Loop portion 64 is then pushed upward through first slot means 36 and due to the resilient nature of the divider material, loop 64 will bend or can be flexed until the detent of engaging means 54 engages the outermost edge of slot means 36. The thus securely attached dividers 18 provide the necessary support, rigidity and firmness to shelf 26.

Although the invention has been described in terms of specific embodiments and applications, persons skilled in the art, in light of this teaching, can generate additional embodiments without department from the spirit or exceeding the scope of the claimed inventioin. Accordingly, it is to be understood that the drawings and descriptions in this disclosure are proffered to facilitate comprehension of the invention and should not be construed to limit the scope thereof.

What is claimed is:

1. A shelf with a divider arrangement, of the type which is provided with a horizontal base member having a longitudinal axis and first and second longitudinal edes, side members and a vertical back member disposed contiguous to the first longitudinal edge of the base member, and divider members for engaging with the members at a plurality of locations along the longitudinal axis of the base and back members, the divider arrangement characterized by:

(a) a plurality of parallel slot means disposed along the base member and perpendicular to the longitudinal axis thereof, and providing openings for communicating from the upper to the lower surface of the base member, including;
  (i) a first slot means disposed in promixity to the second longitudinal edge of the base member;
  (ii) a second slot means disposed on the base member between the first slot means and said first longitudinal edge of said base member;

(b) a plurality of anchoring means in proximity to the upper edge of the back member and being in alignment with the first and second slot means of the base member;

(c) a plurality of dividers removably engaging the base and back members comprising:
  (i) a first portion engaging the first slot means and forming a loop extending above and perpendicular to the upper surface of the base member;
  (ii) a second portion thereof extending from the loop under the lower surface of the base member, and up through the second slot means of the base member and angularly engaging said anchoring means in alignment with the first and second slot means.

2. A shelf as in claim 1 wherein said first portion of each said divider comprises first engaging means, and said second portion of each said divider comprises a second engaging means, wherein said first engaging means comprises a detent for fixedly engaging the front edge of said first slot means, and said second engaging means comprises an angular hook engaging said anchoring means.

3. A shelf as in claim 2, wherein said first engaging means of each divider exerts an outwardly deflected force against the outer edge of sid first slot means and said second portion of each divider means exerts a downward force against said anchoring means; said divider means thereby providing support for said base member.

4. A shelf as in claim 3 wherein said divider arrangement has an auxiliary divider means disposed in said base member between said first longitudinal edge and said second slot means.

5. A shelf as in claim 4 wherein said divider means is U-shaped in configuration.

6. A shelf as in claim 1 wherein said dividers are made of spring steel.

7. A shelf as in claim 1 wherein said dividers are made of plastic.

* * * * *